US007513498B2

(12) United States Patent
Elenes et al.

(10) Patent No.: US 7,513,498 B2
(45) Date of Patent: Apr. 7, 2009

(54) PROCESSING SHEET MEDIA

(75) Inventors: Luis Elenes, Camas, WA (US); Jeffrey G. Bingham, Vancouver, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 548 days.

(21) Appl. No.: 10/726,808

(22) Filed: Dec. 2, 2003

(65) Prior Publication Data

US 2005/0179193 A1 Aug. 18, 2005

(51) Int. Cl.
*B65H 29/20* (2006.01)

(52) U.S. Cl. ..... 271/178; 271/314; 271/212

(58) Field of Classification Search ..... 271/272, 271/314, 177, 178, 207, 315, 119, 66, 70, 271/72, 83, 212; 347/104, 101; 492/28, 492/30, 31, 33, 36

See application file for complete search history.

(56) References Cited

U.S. PATENT DOCUMENTS

| | | | | | |
|---|---|---|---|---|---|
| 1,090,473 | A * | 3/1914 | Gullberg et al. | ..... | 271/210 |
| 2,844,373 | A * | 7/1958 | Van Marle | ..... | 271/178 |
| 3,100,110 | A * | 8/1963 | Winkler et al. | ..... | 271/104 |
| 3,704,793 | A * | 12/1972 | Nicol et al. | ..... | 271/178 |
| 3,981,496 | A * | 9/1976 | Jensen et al. | ..... | 271/314 |
| 3,991,996 | A * | 11/1976 | Bass | ..... | 271/314 |
| 4,073,223 | A * | 2/1978 | Crawford | ..... | 226/88 |
| 4,241,911 | A * | 12/1980 | Lee | ..... | 271/314 |
| 4,459,172 | A * | 7/1984 | Achelpohl et al. | ..... | 156/515 |
| 4,589,654 | A * | 5/1986 | Kanoto | ..... | 271/314 |
| 4,681,312 | A * | 7/1987 | Harvey | ..... | 271/207 |
| 5,215,394 | A * | 6/1993 | Kim | ..... | 400/625 |
| 5,234,210 | A * | 8/1993 | Olexy | ..... | 271/184 |
| 5,553,840 | A * | 9/1996 | Arikawa | ..... | 271/3.08 |
| 6,298,214 | B1 * | 10/2001 | Koga | ..... | 399/322 |
| 6,450,713 | B2 | 9/2002 | Parthasarathy et al. | | |
| 6,488,279 | B1 * | 12/2002 | Fukuda et al. | ..... | 271/314 |
| 6,666,448 | B2 * | 12/2003 | Sato et al. | ..... | 271/177 |
| 6,776,410 | B2 * | 8/2004 | Fukuda | ..... | 271/207 |
| 6,779,790 | B2 * | 8/2004 | Kitahara | ..... | 270/58.12 |
| 7,004,463 | B2 * | 2/2006 | Eugster et al. | ..... | 271/187 |
| 7,243,914 | B2 * | 7/2007 | Tokunaga et al. | ..... | 271/3.01 |
| 2002/0180142 | A1 * | 12/2002 | Sisk | ..... | 271/198 |
| 2003/0179272 | A1 * | 9/2003 | Saito et al. | ..... | 347/104 |
| 2005/0068401 | A1 * | 3/2005 | Aoki | ..... | 347/104 |

FOREIGN PATENT DOCUMENTS

| | | | |
|---|---|---|---|
| JP | 58183558 | A * | 10/1983 |
| JP | 60171963 | A * | 9/1985 |
| JP | 01261161 | A * | 10/1989 |
| JP | 04246054 | A * | 9/1992 |
| JP | 05024676 | A * | 2/1993 |
| JP | 05147805 | A * | 6/1993 |
| JP | 06064814 | A * | 3/1994 |

* cited by examiner

*Primary Examiner*—Patrick H Mackey
*Assistant Examiner*—Jeremy Severson

(57) ABSTRACT

A method of processing sheet media is provided. The method may include moving a sheet medium upward by contact of a face of the sheet medium with a roller. The method also may include carrying a trailing edge of the sheet medium upward and then over the roller.

17 Claims, 3 Drawing Sheets

Fig. 1
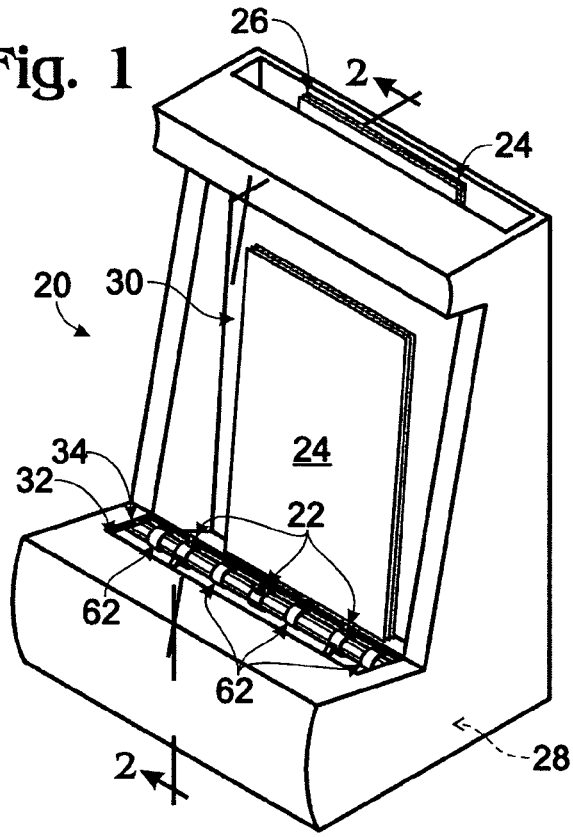
Fig. 2
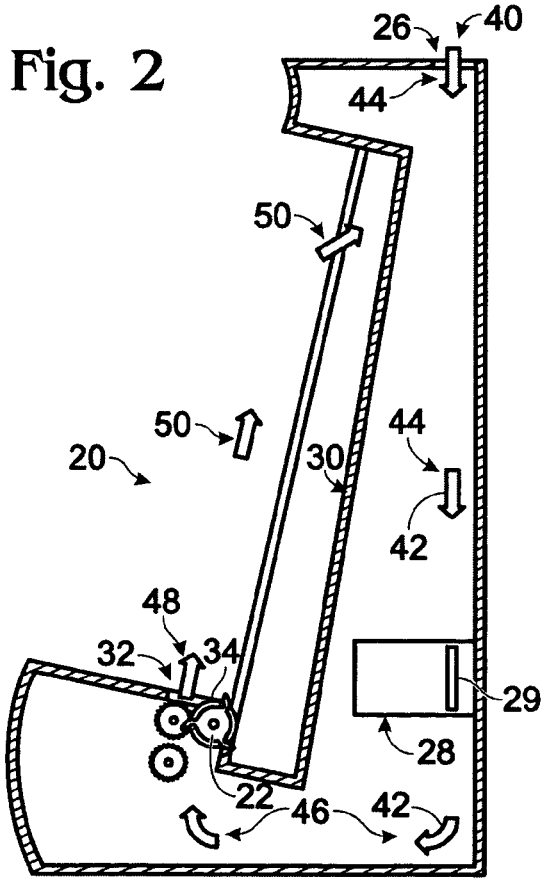
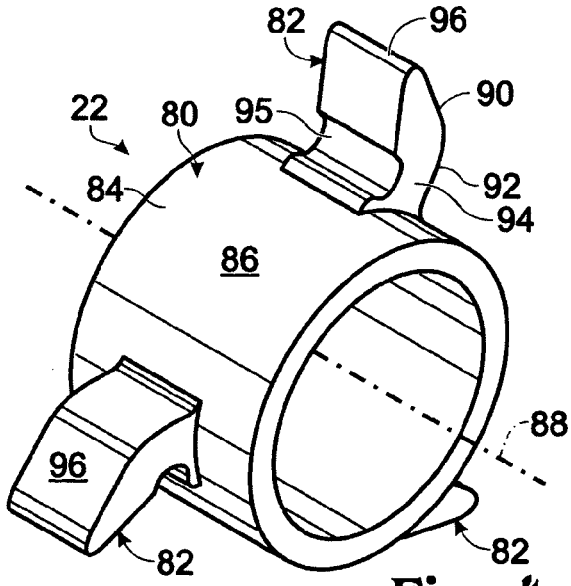
Fig. 4

PROCESSING SHEET MEDIA

BACKGROUND

Media processing apparatus may process media, such as printing on sheets of paper, as the media is moved from an input site to an output site. Movement of the media within such apparatus may be provided by rotation of a roller. The roller may function to propel the media forward, tangentially along a linear path from the roller as the roller sequentially contacts surface regions arrayed along a movement axis of the media.

Media processing apparatus may move media from a site of processing to the output site. Accordingly, the relative spatial disposition of the processing site and the output site may determine the direction toward which an output roller should move media toward the output site. In some cases, there is a need for an output roller configured to move the media upward from the processing site to the output site.

BRIEF DESCRIPTION OF THE DRAWINGS

FIG. 1 is a view of a printing apparatus configured to input and output print media in a substantially vertical orientation, in accordance with an embodiment of the invention.

FIG. 2 is a sectional view of the printing apparatus of FIG. 1 taken generally along plane 2-2 of FIG. 1 and indicating a path followed by print media through the printing apparatus, in accordance with an embodiment of the invention.

FIG. 4 is a view of a media displacement device that connects to the roller of the media movement mechanism of FIG. 3, in accordance with an embodiment of the invention.

DETAILED DESCRIPTION

Figure 3:
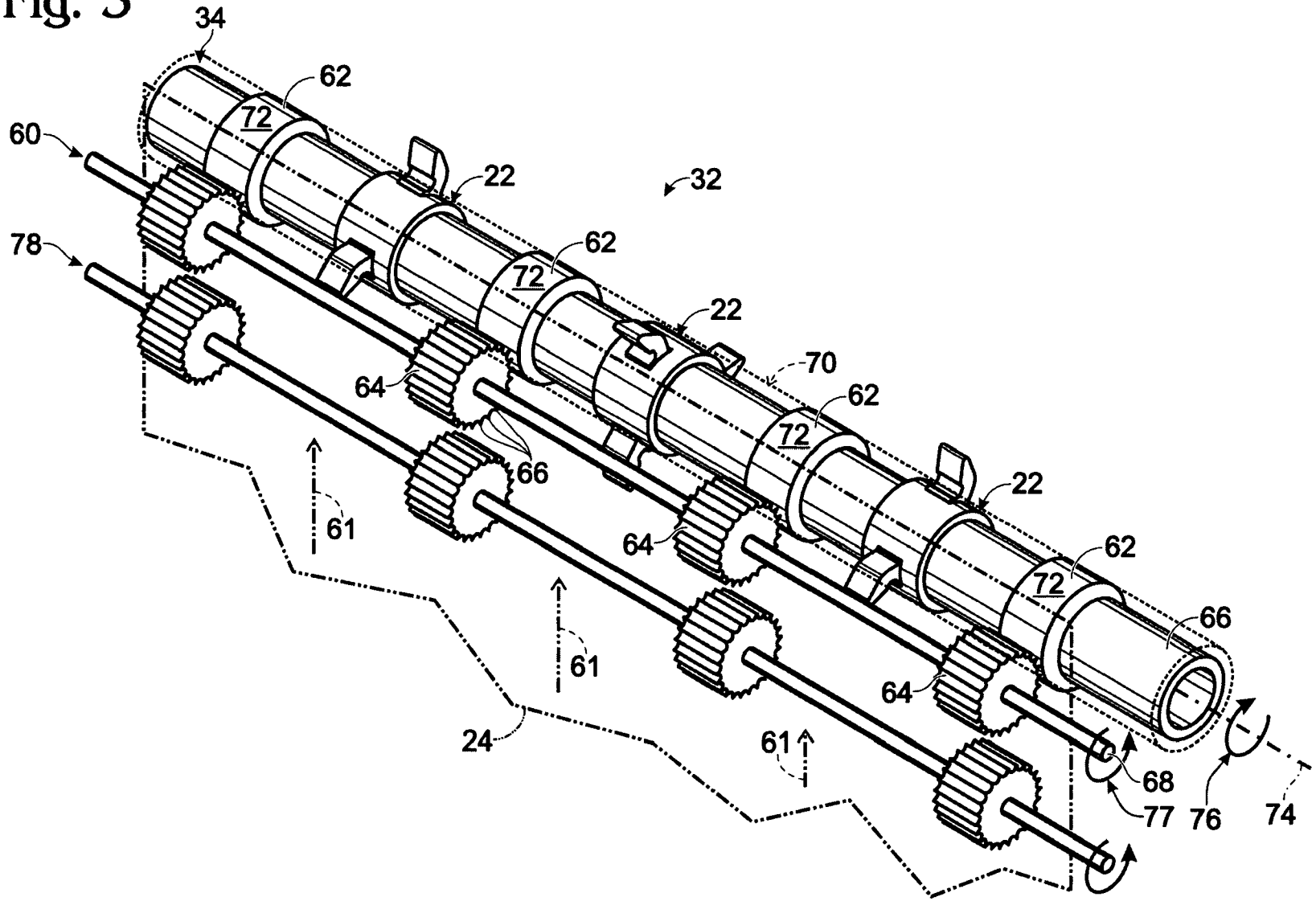
FIG. 3 is a view of a media movement mechanism included in the printing apparatus of FIG. 1 and configured to move print media upward and over a roller of the movement mechanism to an output site, in accordance with an embodiment of the invention.

Systems, including apparatus, methods, and devices, are provided for displacing the trailing edge of a medium from an advancement path defined by a roller mechanism in a media processing apparatus. The apparatus may include printers, such as printers configured to output media by upward movement. The methods may include moving a medium along a substantially linear or planar path by contact between a side of the medium and a rotating structure, such as a roller mechanism, and then displacing a trailing edge of the medium from the linear or planar path, along a substantially arcuate path. The devices may include a displacement device. The displacement device may be configured to be connected to the roller mechanism, to rotate with the roller mechanism, and may have one or more resilient fingers or members. The resilient fingers may have a retracted position and an extended position. The fingers may be deflected to the retracted position by contact with a face of the medium, to permit linear movement of the medium past the roller mechanism. In the extended position, one or more of the resilient fingers may engage the trailing edge of the medium and carry the trailing edge along a rotational path of the one or more fingers. Accordingly, the displacement device may enable more effective separation of a medium from a roller mechanism, particularly a roller mechanism that moves media upward.

FIG. 1 shows an embodiment of a printing apparatus or printer 20 that may employ one or more of the media displacement devices 22 described herein. Printer 20 may be configured to input and output print media, such as sheets 24 in a substantially vertical orientation. In particular, printer 20 may store print media in an input site 26, such as a cassette, before the print media is processed. A sheet 24 may be moved from the input site to a processing mechanism, such as a colorant application mechanism 28 that places colorant positionally on the sheet. The colorant application mechanism may be, for example, an inkjet print engine or a laser jet print engine. The colorant may be any material that changes the optical properties of a sheet medium when applied thereto, such as ink or toner, among others. Colorant application mechanism 28 may place colorant on a medium while the medium is disposed in a print zone 29 of the printer. Accordingly, the print zone, as used herein, is a region through which the medium passes for colorant application.

The sheet then may be moved to an output site 30 by a media movement mechanism or output mechanism 32. The output mechanism may include a rotating structure, such as a roller or roller mechanism 34. Displacement devices 22 may be connected to roller 34 so that the displacement devices rotate with the roller.

In other embodiments, displacement devices 22 may be included in any suitable media processing apparatus. Processing, as used herein, may include any structural and/or positional modification of a medium, and may be conducted automatically, that is, without human intervention during processing. Exemplary processing may include applying a colorant (or printing), cutting, sewing, laminating, folding, stapling, binding, and/or sorting media, among others. A media processing apparatus may include one or more mechanisms for moving media along a substantially linear or planar path, generally using a roller mechanism, as described in more detail below. The path may extend upward, that is, with a net increase in elevation with movement. An upward path may be at least substantially vertical, that is, at least about 45, 70, or 80 degrees from horizontal. Exemplary media processing apparatus may include printers, binders, sorters, photocopiers, scanners, staplers, etc.

A medium, as used herein, may be paper, fabric, plastic, or other suitable material. The medium may have any suitable shape. In some embodiments, the medium may be a sheet medium of any suitable dimensions. The sheet may be used as a print medium in a printer.

FIG. 2 shows a sectional view of printer 20. A path 40 that may be followed by a print medium through the printer is indicated by arrows 42. A print medium may enter at input site 26 and may follow a vertical or substantially vertical path downward, shown at 44, toward printing mechanism 28. Before, during, and/or after the print medium passes the printing mechanism, the print medium may be carried through a half-rotation, shown at 46, so that the medium travels upward along a substantially vertical path defined by output mechanism 32, shown at 48. The output mechanism may be configured to output the medium at less than 90 degrees (not perfectly vertical) and angled somewhat toward output site 30, so that the leading edge of the medium falls toward the output site, shown at 50, as the leading edge of the medium advances upward.

FIG. 3 shows selected portions of media movement mechanism 32 of printer 20. Movement mechanism 32 may include a primary roller 34 and an opposing roller 60, positioned to advance a medium 24 upward between the rollers as they rotate, as indicated by dashed vertical arrows 61. A roller, as used herein, is any rotating structure that drives or guides movement of a medium by contact with the medium. The roller may be generally circular in cross section, at some or all positions along the length of the roller. For example, the roller may be a rotating cylinder, or may include one or a plurality of roller elements, such as elements 62 and 64 of primary roller 34 and opposing roller 60, respectively. The roller elements of each roller may be rotationally coupled by a shaft 66, 68 or other coupling mechanism, such as gears, or may be coupled rotationally by rotation of the primary roller (or opposing roller) or by contact with a moving medium (see below). The roller elements may be generally cylindrical or spherical and may have a surface that is smooth, ridged, dimpled, etc. In the present illustration, opposing roller elements 64, also termed starwheels, may include a series of axial ridges 66 or protrusions disposed on the contact surface of the starwheels, for example, to resist media slippage.

Primary roller may define a cylindrical perimeter 70 that guides medium 24. The cylindrical perimeter may be defined fully by the contact surface of a cylindrical roller of constant radius. Alternatively, the cylindrical perimeter may be defined by media contact surfaces 72 and conceptual extension of these surfaces to both ends of the roller, parallel to the axis of rotation 74 of the roller. Stated differently, the cylindrical perimeter is a cylinder concentric with the roller elements and having the same radius as such elements but extending the length of the roller.

Primary roller 34 and opposing roller 60 may contact one another so that primary roller rotates in a first direction, shown at 76, and rotates the opposing roller in the opposite direction, shown at 77. In some embodiments, primary roller 34 and opposing roller 60 may not directly contact one another in the absence of a medium, and may be spaced by the thickness of the medium. The primary roller may be powered by a drive motor, and the opposing roller may rotate passively by contact with the primary roller and/or media advanced by the primary roller. Alternatively, opposing roller 60 may be driven by a motor and primary roller 34 may rotate passively through contact with the opposing roller, or both rollers may be rotated actively. In some embodiments, opposing roller 60 may be replaced by another structure or mechanism that permits advancement of the media, such as a slippery surface. Media movement mechanism 32 also may include one or more auxiliary rollers 78, which may be function, for example, in guiding media toward primary and opposing rollers 34, 60 from an upstream movement mechanism.

Primary roller 34 may be connected to one or a plurality of media displacement devices 22. In the present illustration, three displacement devices may be used to facilitate displacement of various widths of media. However, any suitable number of such mechanisms may be used. The media displacement devices may be disposed along the length of roller 34, for example, by placement along shaft 66 at positions intermediate to roller elements 62. Displacement devices 22 may be configured to be coaxial with roller 34 and to share the same axis of rotation.

FIG. 4 shows a media displacement device 22 separate from roller 34. Displacement device 22 may include a body 80 and one or more resilient members, such as fingers 82, extending generally outward from the body. Body 80 and fingers 82 may be formed unitarily, that is, as one piece, or formed separately and attached to one another. In exemplary embodiments, the body and the fingers are formed of a resilient or elastomeric material, such as silicone rubber, particularly EPDM shore 30 silicone rubber.

Body 80 may have any suitable shape and size. In some embodiments, the body may be substantially annular or may include an annular portion 84 defining an exterior annular surface 86 and a rotational axis 88. The body may have an inner diameter that is about the same as, or slightly undersized relative to, the outer diameter of a roller shaft. Accordingly, displacement device 22 may be press-fit onto the roller by placing an undersized body 80 onto the roller shaft, so that the body is held in place by friction. Alternatively, the body may be fixed in position on a roller with an adhesive or held in position by any other suitable fastener or fastening mechanism. Body 80 may have a thickness, measured radially, that is less that the thickness of a roller element, to enable fingers 82 to extend above and to be deflected substantially below the profile of the roller elements (compare FIGS. 6 and 7 below). Body 80 may have any suitable width that is sufficient to carry one or more fingers 82 across its width. In some embodiments, the body may be wider than an individual finger 82.

In some embodiments, displacement device 22 may not be a component that is separate from roller 34, because the body may be defined by a component of roller 34. For example, one or more of the fingers may be formed as part of the roller, such as one or more fingers formed integrally with a roller element or the shaft, or the fingers may be connected directly to a roller element or the shaft.

Fingers 82 or other resilient members may be present in any suitable number and in any suitable positions on body 80. Body 80 may be connected to one, two, three, four, or more fingers. With a plurality of fingers, the fingers may be disposed symmetrically or asymmetrically about rotational axis 88.

Fingers 82 may include any members that are resilient enough to toggle between a retracted position and an extended position based on presence or absence of contact with a face of the medium. Retracted and extended positions, as used herein, refer to relative distances of a distal portion 90 of the finger from the rotational axis of the displacement device. The retracted position may move the distal portion closer to body 80 and/or rotational axis 88. The retracted position may be achieved by bending or deflecting the finger about an axis or axes that are substantially parallel to the axis of rotation. The direction of bending may be opposite to the direction in which the connected roller is configured to rotate and thus generally opposite to the direction of media movement past the roller to which the finger(s) is connected.

The finger may return to an extended position when the contact is removed. The extended position may enable the finger to engage a trailing edge of the medium for movement of the trailing edge with the finger as the finger rotates. Accordingly, each finger may be stiff enough to resist substantial deflection from the extended position when the finger is in contact with the trailing edge of the medium.

Finger(s) 82 may have any suitable shape and size. Finger 82 may be substantially linear or may follow a nonlinear path as it extends away from body 80, for example, having a bent or arcuate configuration. The finger may extend at any suitable angle relative to the body. For example, the finger may extend radially (orthogonally) from the body or may extend non-radially. In some embodiments a proximal portion 92 may extend more radially from the body than distal portion 90. In some embodiments, the finger may extend from the body (and from the axis of rotation) in a direction that is generally opposite to the direction of rotation of its connected roller (and the direction of media movement), that is, rearward of a radial direction. Rearward, as used herein, refers to a direction generally opposing (away from) the direction of forward media movement and forward rotation of the connected roller.

A base or proximal portion of the finger may include a thinned region 94. The thinned region may extend substantially parallel to the axis of rotation and may be configured to enable the finger to be deformed or bent toward the body to the retracted position through contact with the medium. Accordingly, the thinned region may be defined by a recessed portion 95 disposed on a side of the finger toward which the finger is configured to be bent by contact with a medium, in this case, in a direction opposing the direction of primary roller rotation and media movement.

Finger may have any suitable transverse sectional shape including rectangular, ovalloid, circular, polygonal, curvilinear, and or the like. The finger may have any suitable relationship between its width, measured parallel to the axis of rotation, and its thickness, measured tangentially to the body. In some embodiments, the finger may have a greater width than thickness, to resist bending in an undesired direction and/or twisting of the finger. The finger may taper distally in width and/or thickness, or may have a substantially constant or increasing width and/or thickness.

The finger may define a contact or "smear" surface 96 against which a face of the medium abuts. Contact surface 96 may be substantially planar, or may be convex or concave.

It should be noted the finger may deform a print medium when such finger contacts the face of the print medium. Such deformation may be transmitted through the print medium back to regions of the medium where colorant is being applied, resulting in printing defects. Various aspects of the displacement device described above may reduce such deformation of the medium. For example, configuring the finger to extend away from the direction of rotation and to bend accordingly, rather than extending and bending toward such direction (or extending radially), may reduce deformation of the medium. In addition, configuring the finger to have a thinned region proximal to the body, to reduce the force necessary to bend the finger, also may reduce deformation of the medium. Furthermore, a substantially planar contact surface 96 also may reduce deformation of the medium.

FIGS. 5-10 show a series of views of an output portion 100 of printer 20 as a sheet 102 of print medium is moved toward output site 30. Sheet 102 may be advanced upward along path 48 by media movement mechanism 32. Path 48 is defined at positions proximate to the roller, and may be tangential to the roller and substantially linear or planar. Farther from the roller, either upstream or downstream, the media may move along distinct paths different from path 48, due to the forces of gravity or other media movement mechanisms (see FIG. 2). After the medium has been advanced so that a trailing edge of the medium is adjacent the roller, the medium and particularly the trailing edge may be displaced from path 48 by displacement device 22, which carries the trailing edge toward the output site along an at least substantially arcuate path described by roller 34.

Figure 5:
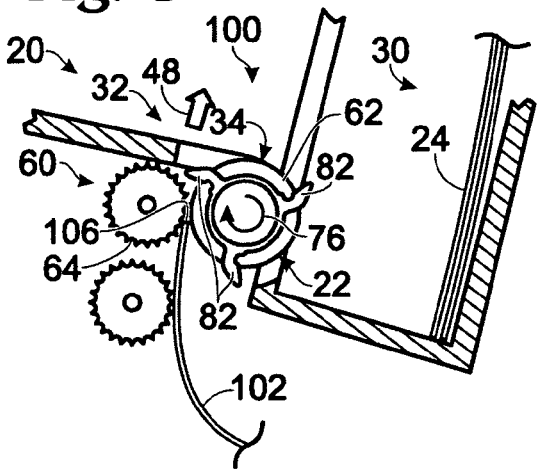
FIGS. 5-10 are fragmentary sectional views of an output portion of the printing apparatus of FIG. 1 as a sheet of print medium is moved upward by the media movement mechanism of FIG. 3 and then carried over a roller of the movement mechanism toward the output site by the media displacement device of FIG. 4.

FIG. 5 shows sheet 102 as leading edge 106 of the sheet is approaching primary roller 34 and opposing roller 60. Sheet 102 may be received from a print zone at which colorant application is performed. Based on the spacing of the print zone from movement mechanism 32, and also based on positions on the sheet at which the colorant is to be placed, placement of the colorant may be in progress, not yet initiated, or completed at this stage. In addition, movement at this stage may be conducted by one or more other media advancement mechanisms disposed upstream of movement mechanism 32.

Figure 6:
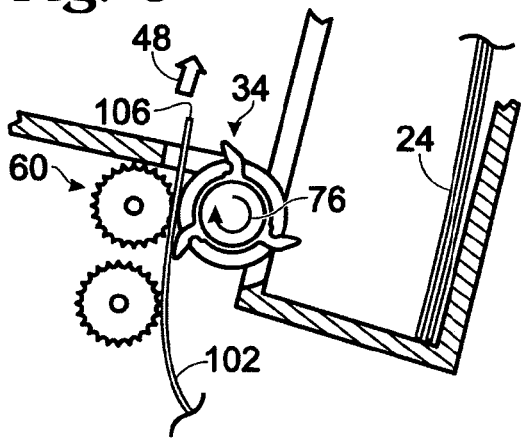

FIG. 6 shows sheet 102 after leading edge 106 of the medium has passed through the movement mechanism, between primary roller 34 and opposing roller 60. Leading edge 106 is following linear path 48 at this stage.

Figure 7:
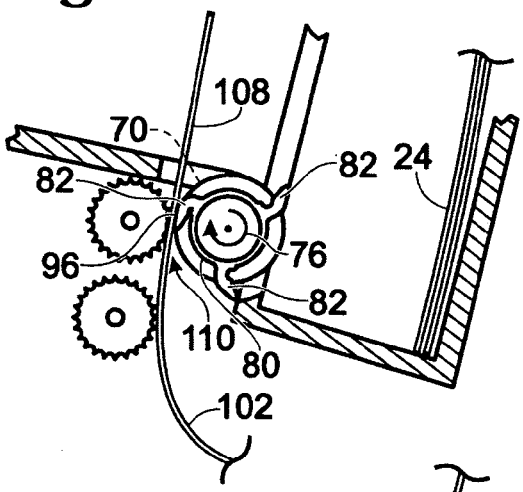

FIG. 7 shows sheet 102 after a face 108 of the sheet contacts and deflects resilient finger 82, to produce a retracted position, shown at 110. In the retracted position, the resilient finger may be deflected so that the finger bends about one or more axes that are parallel to the axis of rotation of roller 34, such as in thinned region 94 (see FIG. 4). Bending may be toward body 80, and may be produced by rotation of the finger at the site of bending in a direction (counterclockwise in this view) that is opposite to the direction roller 34 is rotating, shown at 76. Contact surface 96 of the finger may abut face 108 of the paper and may be disposed substantially tangential to cylindrical perimeter 70 defined by roller 34 (see FIG. 3). Accordingly, distal portion 90 of the finger (see FIG. 4) may be disposed substantially inside perimeter 70 and thus substantially inside the radius of the roller.

Figure 8:
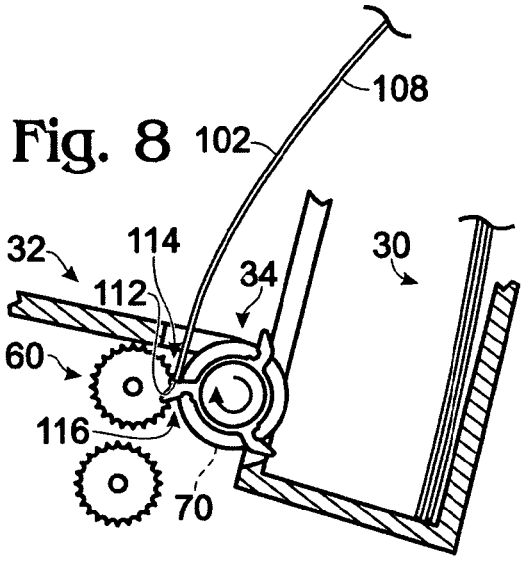

FIG. 8 shows sheet 102 after it has passed through rollers 34, 60. Trailing edge 112 of the medium is disposed in a valley or groove 114 formed between rollers 34, 60. Because face 108 of sheet 102 is no longer pushed against primary roller 34 by opposing roller 60, primary roller 34 may be unable to engage trailing edge sufficiently to carry the trailing edge out of valley 114. Accordingly, sheet 102 may remain in contact with output mechanism 32. However, a resilient finger may be rotated into contact with trailing edge 112, to engage the trailing edge while the finger is in its extended position, shown at 116. An extended position, as used herein, is any position in which the finger can engage and retain the trailing edge of the medium. The extended position may place a substantial amount of the distal portion of the finger outside of the cylindrical perimeter 70 of roller 34 and thus outside the radius of the roller.

Figure 9:
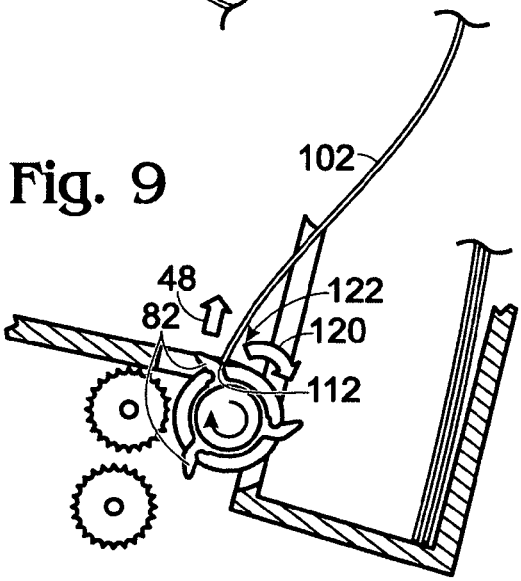

FIG. 9 shows trailing edge 112 being carried away from path 48 along a substantially arcuate path 120 defined by rotation of finger 82 in engagement with trailing edge 112, shown at 122. In some embodiments, finger 82 may carry media through a portion of a circular path described by the roller. In some embodiments, the portion may be an angle of about ninety degrees to about one-hundred eighty degrees. Finger 82 may provide additional upward movement of the trailing edge from that provided by movement along path 48, and also may provide net horizontal or lateral movement of the trailing edge. The horizontal or lateral movement carries the trailing edge over a top portion of the roller and may include downward movement after the upward movement. Accordingly, the finger may be described as carrying the trailing edge upward and then over the roller. In some embodiments, the lateral movement may be by a distance of about the diameter of roller 34 and cylindrical perimeter 70.

Figure 10:
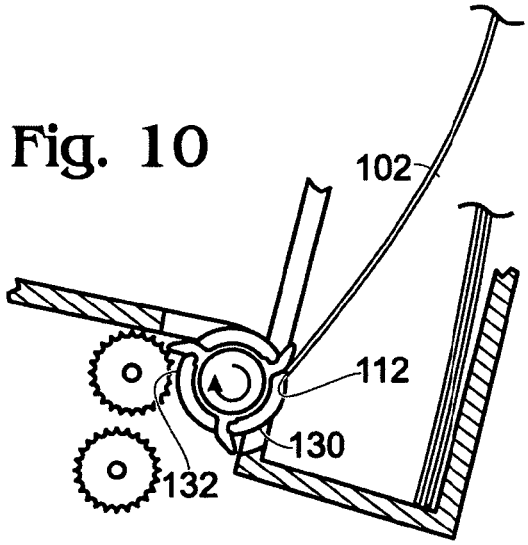

FIG. 10 shows trailing edge 112 disposed on an output side 130 that opposes advancement side 132. A finger may move the trailing edge between opposing sides of the roller so that gravity can finish placement of the trailing edge into the output site. In the present illustration, the trailing edge has reached a position at which gravity takes over.

It is believed that the disclosure set forth above encompasses multiple distinct embodiments of the invention. While each of these embodiments has been disclosed in specific form, the specific embodiments thereof as disclosed and illustrated herein are not to be considered in a limiting sense as numerous variations are possible. The subject matter of this disclosure thus includes all novel and non-obvious combinations and subcombinations of the various elements, features, functions and/or properties disclosed herein. Similarly, where the claims recite "a" or "a first" element or the equivalent thereof, such claims should be understood to include incorporation of one or more such elements, neither requiring nor excluding two or more such elements.

What is claimed is:

1. A method of processing sheet media, comprising:

moving a sheet medium upward by contact of a face of the sheet medium with a roller rotating about an axis of rotation; and carrying a trailing edge of the sheet medium upward and then over the roller with a member, wherein the member includes a body and at least one finger projecting from the body, wherein the member is connected to the roller such that the finger completely orbits the axis of rotation along a circular path, wherein the finger has a distal tip that is spaced farthest from the body and a proximal portion disposed adjacent the body, wherein the finger has an undeflected configuration that defines a central axis extending away from the body to the distal tip along a nonlinear path, wherein the proximal portion of the finger includes a thinned region defined by a recessed portion disposed on a side of the finger, and wherein the moving includes rotating the roller in a first direction and deflecting the finger in a second direction opposite to the first direction.

2. The method of claim 1, wherein the carrying includes engaging the trailing edge with the finger.

3. The method of claim 1, wherein the carrying a trailing edge further comprises carrying the trailing edge of the sheet medium through about 90 to about 180 degrees of a circular path.

4. The method of claim 1, further comprising spacing the trailing edge from the roller using gravity after carrying.

5. The method of claim 1, further comprising placing colorant on the sheet medium before the carrying.

6. The method of claim 1, wherein deflecting the finger in the second direction further includes deflecting the finger toward the side of the finger on which the recessed portion is disposed.

7. A media processing apparatus, comprising:

a rotatable member; and at least one resilient finger connected to the rotatable member, the at least one resilient finger configured to engage a trailing edge of a sheet medium and lift the trailing edge upward and over the rotatable member as the rotatable member rotates, wherein the rotatable member is configured to rotate m a direction, and wherein the at least one resilient finger is configured to bend opposite to the direction upon contact with a face of the sheet medium, wherein the at least one resilient finger is configured to have a retracted position and an extended position, wherein the at least one resilient finger is configured to be placed in the retracted position by contact with a face of the sheet medium and to return to the extended position when the contact is removed, wherein the rotatable member defines a radius, wherein the at least one resilient finger includes a distal portion spaced farthest from the rotatable member and configured to be disposed inside the radius in the retracted position and outside the radius in the extended position, and wherein the at least one resilient finger includes a proximal portion disposed adjacent the rotatable member, wherein the distal portion of the at least one resilient finger tapers in thickness to a distal tip, and wherein the proximal portion of the at least one resilient finger includes a thinned region defined by a recessed portion disposed on a side of the at least one resilient finger at which the at least one resilient finger bends selectively in response to the contact with the face of the sheet medium.

8. The apparatus of claim 7, wherein the at least one resilient finger includes a plurality of spaced resilient fingers.

9. The apparatus of claim 7, further comprising a colorant application mechanism configured to apply a colorant to the sheet medium.

10. The apparatus of claim 9, further comprising an output site for receiving printed sheet media, and wherein the at least one resilient finger is configured to lift the sheet medium over the rotatable member to enable the trailing edge of the sheet medium to reach the output site.

11. The apparatus of claim 7, wherein the at least one resilient finger is connected integrally to the rotatable member.

12. The apparatus of claim 7, wherein the recessed portion is disposed on a side of the at least one resilient finger toward which the at least one resilient finger bends selectively in response to the contact with the face of the sheet medium.

13. An apparatus for displacing a sheet of print medium from a direction of movement of the print medium produced by a roller, comprising:

a body configured to be connected to the roller for rotation therewith; and at least one resilient finger connected to the body and configured to be deflected toward the body, and generally away from the direction of movement, by contact with a face of the print medium to permit movement of the medium along the path and also being configured to engage a trailing edge of the print medium to carry the trailing edge away from the path as the resilient finger rotates, wherein the at least one resilient finger includes a proximal portion disposed adjacent the body, wherein the proximal portion includes a thinned region formed by a cavity defined by an exterior surface of the resilient finger, wherein the resilient finger bends sharply at the thinned region upon contact with the face of the print medium to produce deflection, and wherein the resilient finger is configured to vertically lift the print medium.

14. A method of processing sheet media, comprising:

moving a sheet medium upward by contact of a face of the sheet medium with a roller rotating about an axis of rotation;

carrying a trailing edge of the sheet medium upward and then over the roller with a member including a body and at least one finger projecting from the body; and spacing the trailing edge of the sheet medium from the roller using gravity after the carrying, wherein the member is connected to the roller such that the finger completely orbits the axis of rotation along a circular path, wherein the finger has a distal tip that is spaced farthest from the axis of rotation and a proximal portion spaced closest to the axis of rotation, wherein the proximal portion of the finger includes a thinned region defined by a recessed portion disposed on a side of the finger, and wherein the finger has an unbiased configuration in which the finger extends away from the body to the distal tip in an undivided fashion along a nonlinear path.

15. The method of claim 14, wherein moving the sheet medium includes rotating the roller in a first direction and deflecting the finger in a second direction opposite to the first direction.

16. The method of claim 15, wherein deflecting the finger further includes deflecting the finger toward the side of the finger on which the recessed portion is disposed.

17. The method of claim 15, wherein deflecting the finger includes bending the finger at the thinned region upon contact with the face of the sheet medium.

* * * * *

UNITED STATES PATENT AND TRADEMARK OFFICE

CERTIFICATE OF CORRECTION

PATENT NO. : 7,513,498 B2
APPLICATION NO. : 10/726808
DATED : April 7, 2009
INVENTOR(S) : Luis Elenes et al.

It is certified that error appears in the above-identified patent and that said Letters Patent is hereby corrected as shown below:

In column 7, line 30, in Claim 7, after "rotate" delete "m" and insert -- in --, therefor.

Signed and Sealed this

Eighth Day of December, 2009

David J. Kappos

David J. Kappos
*Director of the United States Patent and Trademark Office*